US008240932B1

(12) United States Patent
Perez-Espartero et al.

(10) Patent No.: US 8,240,932 B1
(45) Date of Patent: Aug. 14, 2012

(54) FOOD HANDLING SYSTEM

(76) Inventors: Martha M. Perez-Espartero, Summerfield, FL (US); Nestor G. Espartero, Summerfield, FL (US)

( * ) Notice: Subject to any disclaimer, the term of this patent is extended or adjusted under 35 U.S.C. 154(b) by 245 days.

(21) Appl. No.: 12/804,347

(22) Filed: Jul. 20, 2010

(51) Int. Cl.
*B65D 35/30* (2006.01)

(52) U.S. Cl. ..... 401/173; 222/390

(58) Field of Classification Search ..... 401/173; 222/390, 405, 160, 164, 412, 413; 99/534, 99/535, 345, 348, 494, 516; 220/735
See application file for complete search history.

(56) References Cited

U.S. PATENT DOCUMENTS 3,241,729 A * 3/1966 Gabler ..... 222/390
3,333,740 A * 8/1967 Waller ..... 222/182
3,815,787 A * 6/1974 Spies ..... 222/95
5,042,696 A * 8/1991 Williams ..... 222/340
5,143,259 A * 9/1992 Williams ..... 222/80
5,722,782 A * 3/1998 Rosenthal ..... 401/75
6,655,550 B2 * 12/2003 Garcia et al. ..... 222/103

* cited by examiner

*Primary Examiner* — Stephen Castellano

(57) ABSTRACT

An outer tube has a cylindrical configuration with open upper and lower ends. Linear recess are formed in the outer tube. An inner tube has a cylindrical configuration with open upper and lower ends. A spiral slit is formed in essentially the entire length of the inner tube. The inner tubes is rotatably received within the outer tube. A twist cap has a circular lower face. The lower face is secured to the lower end of the inner tube. The twist cap has a cylindrical side wall receiving the lower end of the outer tube. A stuffer has a circular lower face and a cylindrical side wall. The stuffer is slidably received within the inner tube. Fingers extend radially outwardly from the side wall of the stuffer. Each finger extends through the spiral slit and terminates in a linear recess.

6 Claims, 2 Drawing Sheets

FOOD HANDLING SYSTEM

BACKGROUND OF THE INVENTION

Field of the Invention

The present invention relates to a food handling system and more particularly pertains to receiving and supporting food and for dispensing the supported food as desired, the receiving and supporting and dispensing being done in a safe, sanitary, convenient and economical manner.

SUMMARY OF THE INVENTION

In view of the foregoing disadvantages inherent in the known types of handling systems of known designs and configurations now present in the prior art, the present invention provides an improved food handling system. As such, the general purpose of the present invention, which will be described subsequently in greater detail, is to provide a new and improved food handling system and method which has all the advantages of the prior art and none of the disadvantages.

To attain this, the present invention essentially comprises a food handling system. First provided is an outer tube. The outer tube is provided in a cylindrical configuration. The outer tube has an open upper end. The outer tube has an open lower end. The upper and lower ends are separated by a length. The outer tube has an interior surface. The outer tube has an exterior surface. A common first diameter is provided along the length of the outer tube. The interior surface has a first linear recess. The first linear recess is provided along the entire length of the outer tube. The interior surface has a second linear recess. The second linear recess is provided along the upper end of the outer tube to a location adjacent to the lower end of the outer tube. The second linear recess is provided diametrically opposite from the first linear recess. The outer rube has an inwardly extending annular recess. The inwardly extending annular recess is provided adjacent to the lower end of the outer tube.

An inner tube is provided. The inner tube is provided in a cylindrical configuration. The inner tube has an open upper end. The inner tube has an open lower end. The upper end and the lower end are separated by a length. The length of the separation is essentially equal to the length of the outer tube. The inner tube has an interior surface. The inner tube has an exterior surface. A common second diameter is provided along the length of the inner tube. The second diameter is less than the first diameter. The inner tube has a spiral slit. The spiral slit is provided essentially along the entire length of the inner tube. The inner tubes are rotatably received within the outer tube. The inner and outer tubes are fabricated of a transparent, generally rigid plastic material.

Provided next is a twist cap. The twist cap has a circular lower face. The circular lower face of the twist cap is secured to the lower end of the inner tube. The twist cap has a cylindrical side wall. In this manner the lower end of the outer tube is received. The twist cap has an inwardly extending annular projection. The inwardly extending annular projection is received in the annular recess. In this manner holding the outer tube fixed in one hand and rotating the twist cap with the other hand will rotate the inner tube with respect to the outer tube.

An inside stuffer is provided. The inside stuffer has a circular lower face. The inside stuffer has a cylindrical side wall. The inside stuffer is slidably received within the inner tube. In this manner axial movement is provided. First and second fingers are provided. The first and second fingers extend radially outwardly from the side wall of the inside stuffer. Each finger extends through the spiral slit. The first finger terminates in the first linear recess. The second finger terminates in the second linear recess. The fingers are provided at different elevations. The fingers are axially spaced by the pitch of the spiral cut. In this manner rotation of the inner tube will axially raise the inside stuffer and any food thereon to an elevated location above the tubes for consumption purposes.

Further provided is a cover cap. The cover cap has a circular upper face. The cover cap has a generally cylindrical side wall. The cover cap has a hinge. The hinge pivotably couples the cover cap to the upper end of the outer tube. In this manner the cover cap may move between a close orientation above the upper end of the outer tube and an open orientation laterally spaced from the upper end of the outer tube. The cover cap has a finger grip. The finger grip is located opposite from the hinge. In this manner handling is facilitated. The side wall of the cover cap has a break away panel. The break away panel is adapted to be removed. In this manner access to interior of the inner tube is facilitated.

Provided last is a plurality of sauce applicators. The sauce applicators are coupled to the cover cap between the side wall. The sauce applicators are adapted to be squeezed. In this manner sauces are ejecting to food received and stored and advanced by the inside stuffer. The sauces include soy and wasabi for sushi, salsa and picante for burritos and chocolate and fruit preserve for ice cream. In the preferred embodiment, the twist cap, inside stuffer, cover cap and sauce applicators are fabricated of a plastic material. The preferred sizes include, for the tubes, 8.5 inches in length, for the twist cap: 1.75 inches as an outside diameter and 1.0 inches in axial length, for the end cap: 1.0 inches in axial height for the majority of the extent: for the break away panel, 0.5 inches in axial height and 0.75 inches in circumferential width, for the inside stuffer: 0.5 inches in axial height and 1.5 inches in circumferential: for the spiral, 1.0 inches in pitch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved food handling system which has all of the advantages of the prior art handling systems of known designs and configurations and none of the disadvantages.

It is another object of the present invention to provide a new and improved food handling system which may be easily and efficiently manufactured and marketed.

It is further object of the present invention to provide a new and improved food handling system which is of durable and reliable constructions.

An even further object of the present invention is to provide a new and improved food handling system which is susceptible of a low cost of manufacture with regard to both materials and labor, and which accordingly is then susceptible of low prices of sale to the consuming public, thereby making such food handling system economically available to the buying public.

Even still another object of the present invention is to provide a food handling system for receiving and supporting food and for dispensing the supported food as desired, the receiving and supporting and dispensing being done in a safe, sanitary, convenient and economical manner.

Lastly, it is an object of the present invention to provide a new and improved food handling system. An outer tube has a cylindrical configuration with open upper and lower ends. Linear recess are formed in the outer tube. An inner tube has a cylindrical configuration with open upper and lower ends. A spiral slit is formed in essentially the entire length of the inner tube. The inner tubes is rotatably received within the outer tube. A twist cap has a circular lower face. The lower face is secured to the lower end of the inner tube. The twist cap has a cylindrical side wall receiving the lower end of the outer tube. A stuffer has a circular lower face and a cylindrical side wall. The stuffer is slidably received within the inner tube. Fingers extend radially outwardly from the side wall of the stuffer. Each finger extends through the spiral slit and terminates in a linear recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
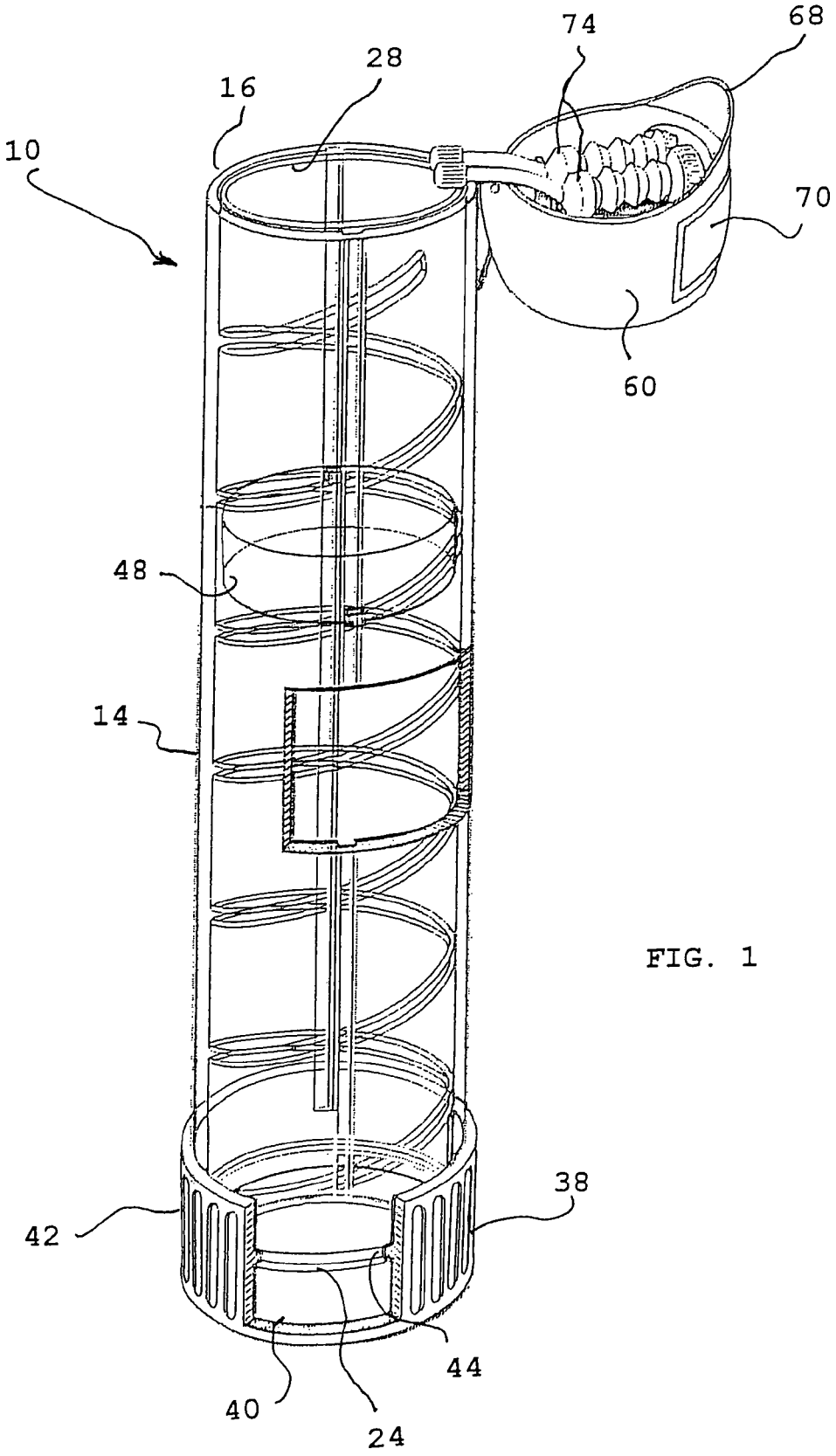
FIG. 1 is a cross sectional view of a food handling system constructed in accordance with the principles of the present invention.
Figure 2:
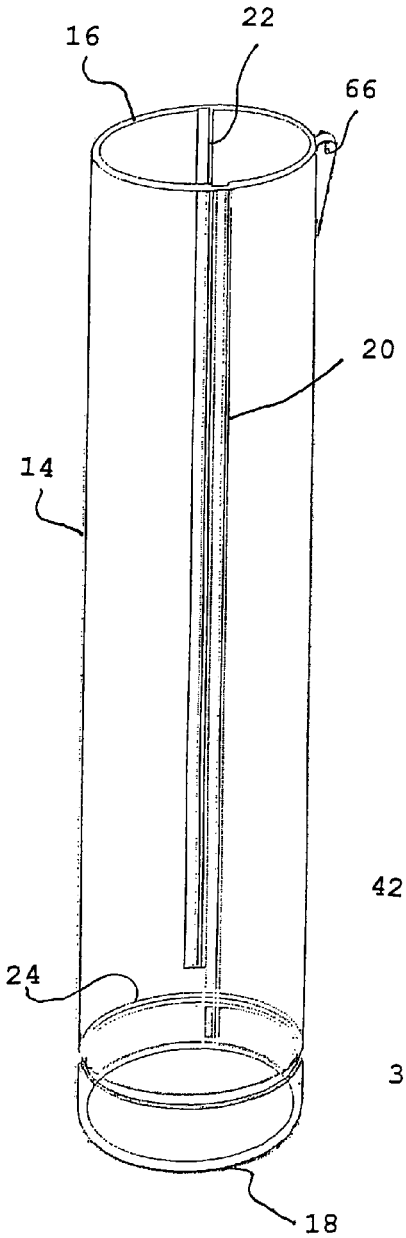
FIG. 2 is a perspective illustration of the outer tube shown in FIG. 1.
Figure 3:
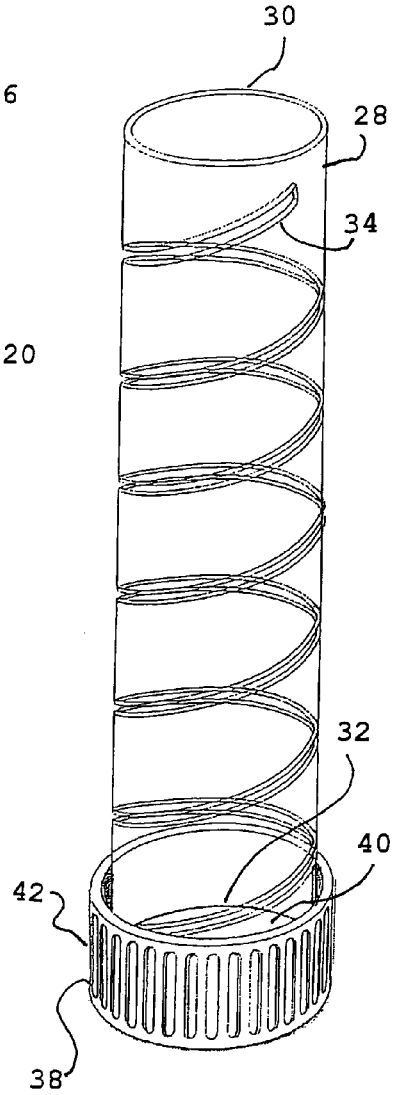
FIG. 3 is a perspective illustration of the inner tube and twist cap shown in FIG. 1.
Figure 4:
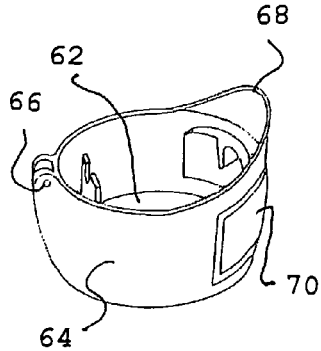
FIG. 4 is a perspective illustration of the cover cap shown in FIG. 1.
Figure 5:
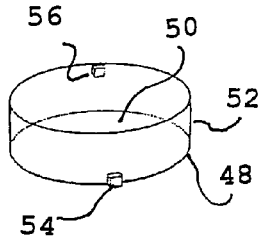
FIG. 5 is a perspective illustration of the inside stuffer shown in FIG. 1.
Figure 6:
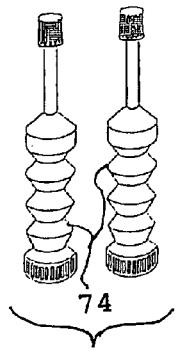
FIG. 6 is a perspective illustration of the sauce applicators shown in FIG. 1.

With reference now to the drawings, and in particular to FIG. 1 thereof, the preferred embodiment of the new and improved food handling system embodying the principles and concepts of the present invention and generally designated by the reference numeral 10 will be described.

The present invention, the food handling system 10 is comprised of a plurality of components. Such components in their broadest context include an outer tube, an inner tube, a twist cap and a stuffer. Such components are individually configured and correlated with respect to each other so as to attain the desired objective.

First provided is an outer tube 14. The outer tube is provided in a cylindrical configuration. The outer tube has an open upper end 16. The outer tube has an open lower end 18. The upper and lower ends are separated by a length. The outer tube has an interior surface. The outer tube has an exterior surface. A common first diameter is provided along the length of the outer tube. The interior surface has a first linear recess 20. The first linear recess is provided along the entire length of the outer tube. The interior surface has a second linear recess 22. The second linear recess is provided along the upper end of the outer tube to a location adjacent to the lower end of the outer tube. The second linear recess is provided diametrically opposite from the first linear recess. The outer rube has an inwardly extending annular recess 24. The inwardly extending annular recess is provided adjacent to the lower end of the outer tube.

An inner tube 28 is provided. The inner tube is provided in a cylindrical configuration. The inner tube has an open upper end 30. The inner tube has an open lower end 32. The upper end and the lower end are separated by a length. The length of the separation is essentially equal to the length of the outer tube. The inner tube has an interior surface. The inner tube has an exterior surface. A common second diameter is provided along the length of the inner tube. The second diameter is less than the first diameter. The inner tube has a spiral slit 34. The spiral slit is provided essentially along the entire length of the inner tube. The inner tubes are rotatably received within the outer tube. The inner and outer tubes are fabricated of a transparent, generally rigid plastic material.

Provided next is a twist cap 38. The twist cap has a circular lower face 40. The circular lower face of the twist cap is secured to the lower end of the inner tube. The twist cap has a cylindrical side wall 42. In this manner the lower end of the outer tube is received. The twist cap has an inwardly extending annular projection 44. The inwardly extending annular projection is received in the annular recess. In this manner holding the outer tube fixed in one hand and rotating the twist cap with the other hand will rotate the inner tube with respect to the outer tube.

An inside stuffer 48 is provided. The inside stuffer has a circular lower face 50. The inside stuffer has a cylindrical side wall 52. The inside stuffer is slidably received within the inner tube. In this manner axial movement is provided. First and second fingers 54, 56 are provided. The first and second fingers extend radially outwardly from the side wall of the inside stuffer. Each finger extends through the spiral slit. The first finger terminates in the first linear recess. The second finger terminates in the second linear recess. The fingers are provided at different elevations. The fingers are axially spaced by the pitch of the spiral cut. In this manner rotation of the inner tube will axially raise the inside stuffer and any food thereon to an elevated location above the tubes for consumption purposes.

Further provided is a cover cap 60. The cover cap has a circular upper face 62. The cover cap has a generally cylindrical side wall 64. The cover cap has a hinge 66. The hinge pivotably couples the cover cap to the upper end of the outer tube. In this manner the cover cap may move between a close orientation above the upper end of the outer tube and an open orientation laterally spaced from the upper end of the outer tube. The cover cap has a finger grip 68. The finger grip is located opposite from the hinge. In this manner handling is facilitated. The side wall of the cover cap has a break away panel 70. The break away panel is adapted to be removed. In this manner access to interior of the inner tube is facilitated.

Provided last is a plurality of sauce applicators 74. The sauce applicators are coupled to the cover cap between the side wall. The sauce applicators are adapted to be squeezed. In this manner sauces are ejecting to food received and stored and advanced by the inside stuffer. The sauces include soy and wasabi for sushi, salsa and picante for burritos and chocolate and fruit preserve for ice cream.

In the preferred embodiment, the twist cap, inside stuffer, cover cap and sauce applicators are fabricated of a plastic material. The preferred sizes include for the tubes—8.5 inches in length, and for the twist cap—1.75 inches as an outside diameter and 1.0 inches in axial length, and for the cover cap—1.0 inches in axial height for the majority of the extent, and for the break away panel—0.5 inches in axial height and 0.75 inches in circumferential width, and for the inside stuffer—0.5 inches in axial height and 1.5 inches in circumferential, and for the spiral—1.0 inches in pitch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A food handling system comprising:

an outer tube having a cylindrical configuration with open upper and lower ends, linear recess formed in the outer tube;

an inner tube having a cylindrical configuration with open upper and lower ends, a spiral slit formed in essentially the entire length of the inner tube, the inner tubes being rotatably received within the outer tube;

a twist cap having a circular lower face secured to the lower end of the inner tube, the twist cap having a cylindrical side wall receiving the lower end of the outer tube; and a stuffer having a circular lower face and a cylindrical side wall, the stuffer slidably received within the inner tube, fingers extending radially outwardly from the side wall of the stuffer, each finger extending through the spiral slit and terminating in a linear recess.

2. The system as set forth in claim 1 and further including an inwardly extending annular recess in the outer tube adjacent to the lower end of the outer tube and an inwardly extending annular projection extending from the twist cap and received within the annular recess.

3. The system as set forth in claim 1 and further including:

a cover cap having a circular upper face and a generally cylindrical side wall, a hinge pivotably coupling the cover cap to the upper end of the outer tube for movement between a closed orientation above the upper end of the outer tube and an open orientation laterally spaced from the upper end of the outer tube.

4. The system as set forth in claim 3 wherein the side wall of the cover cap includes a break away panel adapted to be removed for facilitating access to interior of the inner tube.

5. The system as set forth in claim 3 and further including:

a plurality of sauce applicators coupled to the cover cap and adapted to be squeezed for the ejecting of sauces to food received and stored and advanced by the stuffer.

6. A food handling system (10) for receiving and supporting food and for dispensing the supported food as desired, the receiving and supporting and dispensing being done in a safe, sanitary, convenient and economical manner, the system comprising, in combination:

an outer tube (14) having a cylindrical configuration with an open upper end (16) and an open lower end (18) separated by a length, the outer tube having an interior surface and an exterior surface with a common first diameter along its length, a first linear recess (20) formed in the interior surface along the entire length of the outer tube, a second linear recess (22) formed in the interior surface from the upper end of the outer tube to a location adjacent to the lower end of the outer tube, the second linear recess being diametrically opposite from the first linear recess, an inwardly extending annular recess (24) formed in the outer tube adjacent to the lower end of the outer tube;

an inner tube (28) having a cylindrical configuration with an open upper end (30) and an open lower end (32) separated by a length essentially equal to the length of the outer tube, the inner tube having an interior surface and an exterior surface with a common second diameter along its length, the second diameter being less than the first diameter, a spiral slit (34) formed in essentially the entire length of the inner tube, the inner tubes being rotatably received within the outer tube, the inner and outer tubes being fabricated of a transparent, generally rigid plastic material;

a twist cap (38) having a circular lower face (40) secured to the lower end of the inner tube, the twist cap having a cylindrical side wall (42) receiving the lower end of the outer tube, the twist cap having an inwardly extending annular projection (44) received in the annular recess whereby holding the outer tube fixed and rotating the twist cap will rotate the inner tube with respect to the outer tube;

an inside stuffer (48) having a circular lower face (50) and a cylindrical side wall (52), the inside stuffer slidably received for axial movement within the inner tube, first and second fingers (54), (56) extending radially outwardly from the side wall of the inside stuffer, each finger extending through the spiral slit and terminating with the first finger in the first linear recess and the second finger in the second linear recess, the fingers being at different elevations axially spaced by the pitch of the spiral cut whereby rotation of the inner tube will axially raise the inside stuffer and any food thereon to an elevated location above the tubes for consumption purposes;

a cover cap (60) having a circular upper face (62) and a generally cylindrical side wall (64), a hinge (66) pivotably coupling the cover cap to the upper end of the outer tube for movement between a close orientation above the upper end of the outer tube and an open orientation laterally spaced from the upper end of the outer tube, the cover cap having a finger grip (68) located opposite from the hinge to facilitate handling, the side wall of the cover cap having a break away panel (70) adapted to be removed for facilitating access to interior of the inner tube; and a plurality of sauce applicators (74) coupled to the cover cap between the side wall, the sauce applicators adapted to be squeezed for the ejecting of sauces to food received and stored and advanced by the inside stuffer.

* * * * *